US009326641B2

(12) United States Patent
Murphy

(10) Patent No.: US 9,326,641 B2
(45) Date of Patent: May 3, 2016

(54) GATED BATH RING

(71) Applicant: Joan Murphy, Lyndhurst, NJ (US)

(72) Inventor: Joan Murphy, Lyndhurst, NJ (US)

( * ) Notice: Subject to any disclaimer, the term of this patent is extended or adjusted under 35 U.S.C. 154(b) by 0 days.

(21) Appl. No.: 14/677,934

(22) Filed: Apr. 2, 2015

(65) Prior Publication Data

US 2015/0313416 A1 Nov. 5, 2015

Related U.S. Application Data

(60) Provisional application No. 61/974,328, filed on Apr. 2, 2014.

(51) Int. Cl.
*A47K 3/024* (2006.01)
*A47K 3/12* (2006.01)

(52) U.S. Cl.
CPC ..... *A47K 3/127* (2013.01); *A47K 3/125* (2013.01); *A47K 3/024* (2013.01)

(58) Field of Classification Search
CPC ..... A47K 3/127
USPC ..... 4/538–595
See application file for complete search history.

(56) References Cited

U.S. PATENT DOCUMENTS 2,379,340 A * 6/1945 Corbett ..... A47K 3/127 4/572.1
2,503,938 A * 4/1950 Davis, Jr. ..... A47K 3/127 297/452.34
3,248,741 A * 5/1966 Stout ..... A47K 3/064 222/78
3,493,976 A * 2/1970 Baker ..... A47K 3/024 297/DIG. 2
3,528,111 A * 9/1970 Chou ..... A47K 3/034 4/572.1
3,995,331 A * 12/1976 Fotre ..... A47K 3/064 4/572.1
4,881,281 A * 11/1989 Lavoine ..... A47K 3/074 4/572.1
5,005,902 A * 4/1991 Farnworth ..... A47D 1/02 297/250.1
5,010,606 A * 4/1991 Bernstein ..... A47K 3/127 297/467
5,033,131 A * 7/1991 Paden ..... A47K 3/034 4/568
5,071,192 A * 12/1991 Adler ..... A47D 1/008 297/174 R
D327,777 S * 7/1992 Tepper ..... A47K 3/024 4/572.1
5,158,460 A * 10/1992 Bernstein ..... A47K 3/127 4/572.1
5,181,284 A * 1/1993 Raphael ..... A47K 3/024 4/572.1
5,276,926 A * 1/1994 Lopez ..... A47K 3/024 4/568
5,317,765 A * 6/1994 Knoedler ..... A47K 3/127 297/411.4
5,321,859 A * 6/1994 Buckshaw ..... A47K 3/127 297/467
5,588,158 A * 12/1996 Poulson ..... A47K 3/127 4/571.1
5,687,433 A * 11/1997 Garner ..... A47K 3/127 297/256.15
6,253,392 B1 * 7/2001 Conforti ..... A47K 3/127 4/572.1
6,507,959 B1 * 1/2003 Sundberg ..... A47K 3/024 4/572.1
6,682,139 B2 * 1/2004 Bellows ..... A47D 1/008 297/136
7,058,995 B2 * 6/2006 Sundberg ..... A47K 3/127 4/572.1
7,533,425 B2 * 5/2009 Monti ..... A47K 3/024 4/572.1
7,810,180 B2 * 10/2010 List ..... A47K 3/074 4/572.1
8,152,239 B2 * 4/2012 Opsvik ..... A47D 1/004 297/148
8,898,825 B2 * 12/2014 Sundberg ..... A47K 3/034 4/572.1

* cited by examiner

*Primary Examiner* — Lori Baker
(74) *Attorney, Agent, or Firm* — Ruth Eure

(57) ABSTRACT

An assistive bath ring for use by a child or adult to provide support for the user to sit in a bathtub. The bath ring comprises an essentially cylindrically shaped framework comprising a circular solid base, a circularly shaped ring attached to the base by height adjusting telescoping leg components; wherein the ring has a front and a rear; and further comprising a hinge in the circular shaped arm rail creating a gate to allow the circularly shaped ring arm rail to open and close.

17 Claims, 2 Drawing Sheets

GATED BATH RING

CLAIM OF PRIORITY

This patent application claims priority under 35 USC 119 (e) (1) from U.S. Provisional Patent Application Ser. No. 61/974,328 filed Apr. 2, 2014, of common inventorship herewith entitled, "Gated Bath Ring," which is incorporated herein by reference as though the same were set forth in its entirety.

FIELD OF THE INVENTION

The present invention pertains to the field of bathtubs, and more specifically to the field of safety accessories in bathing children.

BACKGROUND OF THE INVENTION

The prior art has put forth several designs for safety accessories in bathing children. Among these are:

U.S. Pat. No. 5,687,433 to Michael S. Garner, Craig S. Scherer and Michael C. Thuma describes a bath seat usable in a tub for infants and small children that includes a seat portion with a curved back support mounted thereto. The base includes at least one deformable tub gripping element for removably affixing the seat to a bath tub. The seat includes first and second spaced apart, elongated members which are attached to regions of the back support and extend therefrom. A removable tray is adapted to slidably engage the elongated members. A releasable latch, carried in part on the tray and in part on at least one of the elongated members, locks the tray to the one elongated member in one of a plurality of linearly displaced positions. The seat includes a strut extending between the base and the tray to lockingly engage and support the tray. The strut prevents a child from slipping under the tray and maintains the child in the seat during the bath.

U.S. Pat. No. 5,010,606 to Michael S. Bernstein, David W. Crossley and Michael I. Lerner describes a simple circular bath seat which provides back support and is positionable rotationally in a bath tub where a person bathing a child is enabled to reposition the child and secure the relative position of the seat in order to more easily bath the child.

None of these prior art references describe the present invention.

SUMMARY OF THE INVENTION

It is an object of the present invention to provide an assistive bath ring which is easily adjustable or expandable to accommodate needs of a growing child or a special need's child.

DETAILED DESCRIPTION OF THE INVENTION

Figure 2:
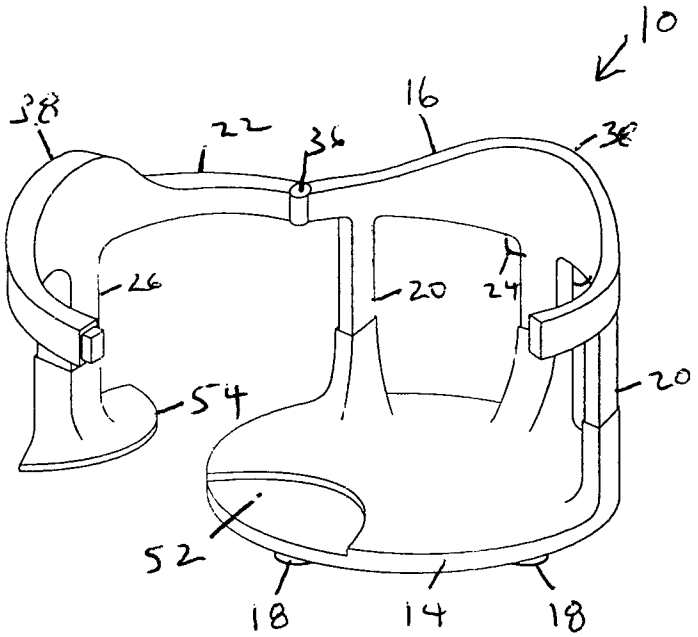
FIG. 2 is an illustrative prototypical top down diagonal view showing the embodiment of the present invention of FIG. 1 in the open position.

For infants and small children, bath time often is associated with free spirited play as splashing in the water and blowing soap bubbles as a fun way to get clean before heading off to bed. Typically, parents bathe their infants in a household bath tub, filling the tub with several inches of water and then holding their child with one arm while they wash the child's body with their other arm and hand. Maintaining a secure grip on a wiggly infant or toddler during bath time sometimes is challenging especially since soap, shampoos and other hygiene products tend to be very viscous and slippery in texture. For a parent or caregiver, maintaining a careful and steady grip on a child while simultaneously attempting to perform simple tasks, such as washing a child's hair or body, is awkward at best. This problem is particularly prevalent for those people who have large garden style bathtubs or old fashioned basin tubs as the tub's placement low to the ground coupled with height of the side walls of the tub make maintaining a firm grip on the child a nearly impossible task, particularly when attempting to gently wash the child's body. If a parent fails to maintain a firm hold on their child, a potential result is that the child slips under water or falls over and bumps their head on the sides or base of the tub; both occurrences are extremely dangerous scenarios.

To ensure a child's safety when bathing an infant, many parents utilize a baby bath ring which is a vertical and circular shaped support structure inside of which the child comfortably sits. The open style of the baby bath ring's framework supports the child in a comfortable, upright position. Typically, these frameworks are constructed so the child can rest their arms on the top of the framework while a vertical support bar extends between the child's legs to facilitate the child in comfortably sitting upright while preventing the child from sliding below the surface of the water. Perhaps one drawback associated with these devices is difficulty in removing the child from the device after the bath. Another drawback is that children outgrow them fairly quickly. Most baby bath rings accommodate children up to fourteen to sixteen months in age. For children who are larger than average or are simply unable to sit upright unassisted past the targeted age range of these devices, standard baby bath rings are simply too small to accommodate these children. This is especially true for children with special needs who, because of mental or physical disabilities, are unable to sit upright on their own. Assisting a child into or out of a bath ring that is too small to accommodate their build is extremely difficult and causes strain and injury to both the child and their caregiver. As such, bathing a child with special needs or who is otherwise too large to utilize a traditional baby bath ring is a challenging endeavor.

The present invention, hereinafter referred to as the Gated Bath Ring, is an assistive baby bath ring comprising adjustable components that accommodate older or larger children. Ideal for use with any able bodied infant or toddler who is too large for a traditional bath ring, the Gated Bath Ring is well suited for use with children who suffer various developmental disabilities that compromise their ability to sit upright unassisted in the bath tub. The Gated Bath Ring is a specially designed bath ring which is easily expandable to accommodate the needs of the growing or special needs child. The Gated Bath Ring comprises an integrated safety gate incorporated into the ring which enables the child to enter and exit the ring from the side of the device, as opposed to requiring the caregiver to lower or lift the child into or out of the center of the unit.

Please refer to the Figures. As with traditional bath rings, the Gated Bath Ring 10 is manufactured primarily of heavy duty, water resistant plastic material and contains coated metal components. The Gated Bath Ring, similar in mechanical style and basic function to traditional bath rings, is comprised of a cylindrically shaped framework. The base 14 of the Gated Bath Ring contains a solid platform on which the child sits, while the top of the present invention is comprised of a circularly shaped ring 16 like arm rail that provides support and stability to the child seated within it. A multiplicity of heavy duty suction cups 18 are positioned appropriately on the underside of the base, providing further stability and structural integrity to the present invention during use. Measuring the same diameter or larger in diameter than traditional bath rings, the Gated Bath Ring includes telescoping leg components 20 that enable the user to adjust the height of the ring in accordance to the size of the child. The four vertical support leg components 20 that connect the upper ring 22 to the base platform 14 are telescoping, enabling the user to raise or lower the ring as necessary, simply by expanding or contracting the legs. Simple interlocking fasteners or a comparable locking mechanism 24 are incorporated into the construction of these support legs, enabling the user to securely lock in the Gated Bath Ring at a designated height. The back and two side support legs 20 connect at the top and bottom to the upper ring and base of the Bath Ring. The front vertical post 26 connects at the base of the seat and its top rounded section 42 rests against an indentation 46 in the closed gate arm.

Figure 1:
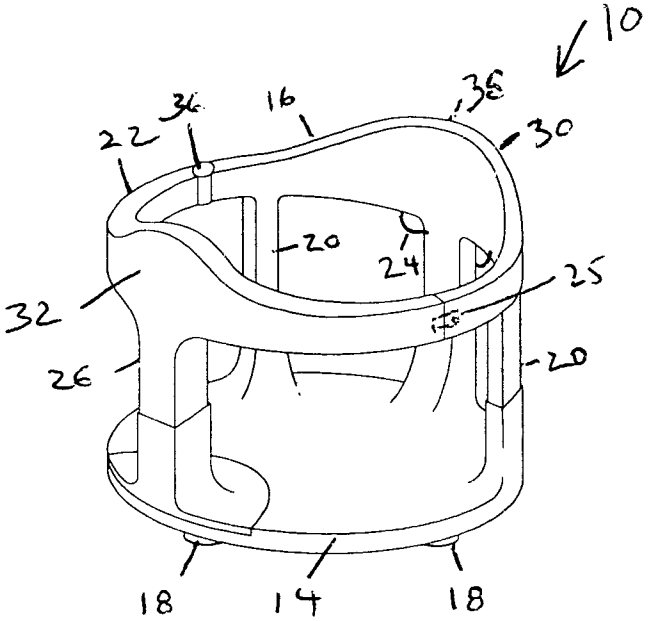
FIG. 1 is an illustrative prototypical top down diagonal view showing one embodiment of the present invention with telescoping legs, showing the device in the closed position. This embodiment has the post mounted to the gate and is designed to be opened at the back.

In the embodiment shown in FIGS. 1 and 2, post 26 is mounted to the upper ring 22, which functions as the gate 32, and is designed for the child to be seated facing front 30. Gate 32 is closed after the child is seated and gate 32 is closed behind the seated child. Also in this embodiment, base 14 comprises indentation 52, for securely receiving expanded base 54 at the bottom of post 26, when the gate 32 is in the closed position.

Figure 4:
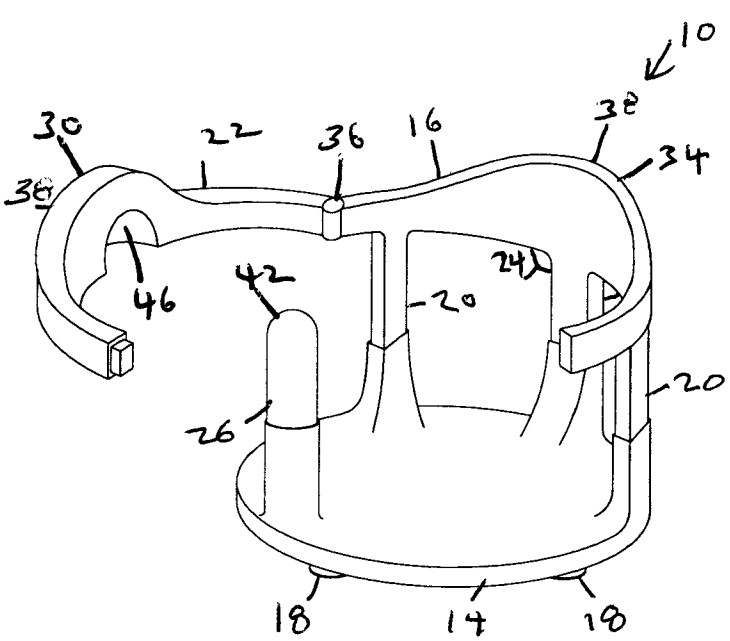
FIG. 4 is an illustrative prototypical top down diagonal view showing the embodiment of the present invention of FIG. 3 in the open position.
Figure 3:
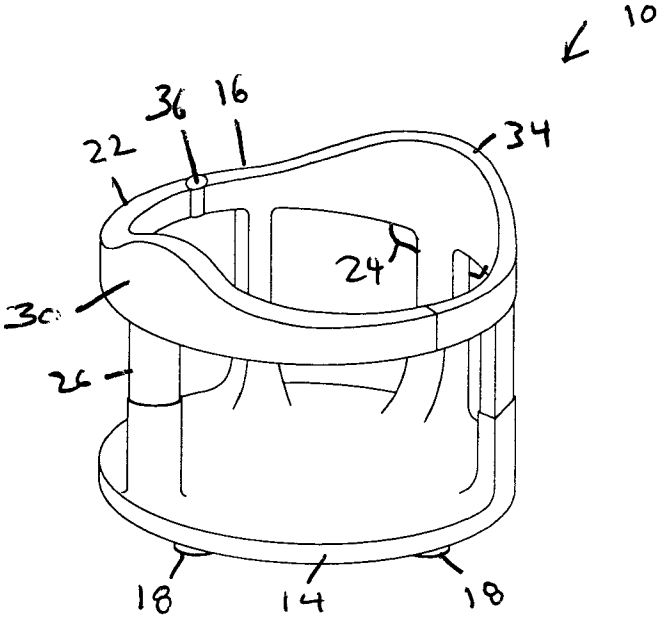
FIG. 3 is an illustrative prototypical top down diagonal view showing an alternative embodiment of the present invention with telescoping legs, showing the device in the closed position. This embodiment has the post mounted to the seat and is designed to open at the front.

In the embodiment shown in FIGS. 3 and 4, post 26 is mounted to base 14, and the child faces front 30, with post 26 situated between the legs of the child. The back of the child rests against the rear 34. Also, in this embodiment, the terminus 42 of post 26 is round or ball shaped to prevent injury to the child. Terminus 42 fits into recess 46 when the gate 30 is closed.

Both embodiments comprise structurally incorporated into the upper ring 22 of the gate is a swivel pinch-free knuckle joint 36 hinged access panel that enables the user to open or close the ring to facilitate access to the child. A simple safety lock 25 secures the gate in a closed position during use. The Gated Bath Ring is manufactured in a variety of whimsical colors to appeal to children. Both embodiments also comprise a raised portions 38 at the front 30 and rear 32, 34 of ring 22 to facilitate support of the child.

Application and use of the Gated Bath Ring is very simple and straight forward. The user installs the Gated Bath Ring within their bath tub. Positioning the Gated Bath Ring so the base rests atop the bottom of the tub, the user presses firmly to adhere suction cups, located on the underside of the present invention, to the tub and thus secure it in place. The user raises or lowers the telescoping support arms in accordance to the height of their child, allowing the child to access the ring like arm rail at a comfortable level. After filling the tub to a safe level with warm water, the user simply opens the gate and assists their child into the Gated Bath Ring. The child sits on the circular platform with one of the vertical support arms positioned between their legs to prevent the child from slipping downwards as they take their bath. Propped up and stabilized with the Gated Bath Ring, the child enjoys their bath as usual with the parent or caregiver assisting the child in washing their hair or performing other hygiene rituals. After use, the tub is drained of water and the Gated Bath Ring is removed from the tub and stored away until again needed.

A cleverly constructed bath ring that is fully adjustable, the Gated Bath Ring is utilized by typical children from about six months of age, as well as those who are older than sixteen-eighteen months of age, yet are unable to sit comfortably upright on their own. Providing reliable stability and support to children who are unable to sit upright in a bath tub, yet are too large for a traditional bath ring, the Gated Bath Ring ensures that bath time is a safe and comfortable activity for the child. Fully adjustable, the Gated Bath Ring is easily raised or lowered to accommodate the height of the child. This advantage will prove especially useful in households where more than one child is present as the device is easily adjusted to accommodate individual children. Durably constructed, the Gated Bath Ring will withstand repeated use with ease.

Although this invention has been described with respect to specific embodiments, it is not intended to be limited thereto and various modifications which will become apparent to the person of ordinary skill in the art are intended to fall within the spirit and scope of the invention as described herein taken in conjunction with the accompanying drawings and the appended claims. For example, older individuals with specific disabilities might benefit from a larger version of the Gated Bath Ring.

The invention claimed is:

1. An assistive bath ring which is easily adjustable or expandable to accommodate needs of a growing child or a special need's child or adult, comprising:

an essentially cylindrically shaped framework having a circular solid base, the base having an underside and a top side;

a circularly shaped arm rail ring attached to the base by a plurality of height adjusting telescoping leg components, the arm rail ring having a front and a rear; and a hinge in the circular shaped arm rail ring creating a gate to allow the circularly shaped arm rail ring to open and close;

wherein the telescoping leg components comprise four leg components; and wherein three leg components are attached to the top side of the base and one leg component is attached to the gate.

2. The assistive bath ring of claim 1 further comprising a multiplicity of suction cups mounted on the underside of the base capable of securing the bath ring to a bathtub.

3. The assistive bath ring of claim 1, further comprising an indentation in the top side of the base to securely receive an expanded base at the bottom of the leg component attached to the gate when the gate is in the closed position.

4. The assistive bath ring of claim 1, wherein the telescoping leg component further comprises an interlocking securing means to enable a user to adjust the height of the leg and secure the height of the leg in place.

5. The assistive bath ring of claim 1, wherein the hinge is a swivel pinch-free knuckle joint.

6. The assistive bath ring of claim 1, further comprising a safety lock to securely close the hinged ring during use.

7. The assistive bath ring of claim 1, manufactured in a variety of whimsical colors to appeal to children.

8. The assistive bath ring of claim 1, wherein the circular shaped ring further comprises raised portions at the front of the ring and the rear of the ring to facilitate support of a user.

9. The assistive bath ring of claim 1 manufactured primarily of heavy duty, water resistant plastic material.

10. An assistive bath ring which is easily adjustable or expandable to accommodate needs of a growing child or a special need's child or adult, comprising:

an essentially cylindrically shaped framework having a circular solid base, the base having an underside and a top side;

a circularly shaped arm rail ring attached to the base by a plurality of height adjusting telescoping leg components, the arm rail ring having a front and a rear; and a hinge in the circular shaped arm rail ring creating a gate to allow the circularly shaped arm rail ring to open and close;

wherein the telescoping leg components comprise four leg components, and all four leg components are attached to the top side of the base;

wherein the four leg components are spaced evenly near the perimeter of the circular base; and wherein an indentation in the gate securely receives a rounded top section of a leg component.

11. The assistive bath ring of claim 10 further comprising a multiplicity of suction cups mounted on the underside of the base capable of securing the bath ring to a bathtub.

12. The assistive bath ring of claim 10, wherein the telescoping leg component further comprises an interlocking securing means to enable a user to adjust the height of the leg and secure the height of the leg in place.

13. The assistive bath ring of claim 10, wherein the hinge is a swivel pinch-free knuckle joint.

14. The assistive bath ring of claim 10, further comprising a safety lock to securely close the hinged ring during use.

15. The assistive bath ring of claim 10, manufactured in a variety of whimsical colors to appeal to children.

16. The assistive bath ring of claim 10, wherein the circular shaped ring further comprises raised portions at the front of the ring and the rear of the ring to facilitate support of a user.

17. The assistive bath ring of claim 10 manufactured primarily of heavy duty, water resistant plastic material.

* * * * *